US005425248A

United States Patent [19]

Trantina

[11] Patent Number: 5,425,248

[45] Date of Patent: Jun. 20, 1995

[54] ICE MAKER SUBASSEMBLY FOR A REFRIGERATOR FREEZER

[75] Inventor: Gerald G. Trantina, Schenectady, N.Y.

[73] Assignee: General Electric Company, Schenectady, N.Y.

[21] Appl. No.: 266,032

[22] Filed: Jun. 27, 1994

[51] Int. Cl.[6] ..... F25C 1/12

[52] U.S. Cl. ..... 62/349; 62/353

[58] Field of Search ..... 62/71, 73, 349, 353

[56] References Cited

U.S. PATENT DOCUMENTS

| | | | |
|---|---|---|---|
| 2,026,214 | 12/1935 | Chilton | 62/353 |
| 2,407,058 | 9/1946 | Clum | 62/353 X |
| 3,004,405 | 10/1961 | Upchurch | 62/353 |
| 3,029,609 | 4/1962 | Zearfoss, Jr. | 62/349 X |
| 3,059,445 | 10/1962 | Kniffin | 62/349 X |
| 3,075,365 | 1/1963 | Hall | 62/349 X |
| 3,247,682 | 4/1966 | Jacobs | 62/353 X |
| 3,908,391 | 9/1975 | Wulke et al. | 62/353 X |
| 4,233,819 | 11/1980 | Sttotmann | 62/349 |

OTHER PUBLICATIONS

Sears Kenmore Refrigerator Owner's Manual (51771/51778), pp. 10–11.

"Crescent Cube Ice Maker"—a single page describing an ice maker that has been on sale in the United States since 1985.

*Primary Examiner*—William E. Tapolcai

*Attorney, Agent, or Firm*—Douglas E. Erickson; Paul R. Webb, II

[57] ABSTRACT

A subassembly for an ice maker includes a double-sided ice cube tray having a housing located within the refrigerator freezer. The housing has a first side with spaced-apart first ice cube cavities facing upward and has a second side with spaced-apart second ice cube cavities facing downward. With frozen ice cubes attached to the second ice cube cavities, household water is delivered to the empty first ice cube cavities. The heat of the water causes the frozen ice cubes to become detached from the second ice cube cavities whereupon gravity causes them to fall into a storage bin below. After the water freezes in the first ice cube cavities, a mechanism rotates the housing one-half turn and the cycle is repeated.

2 Claims, 3 Drawing Sheets

ICE MAKER SUBASSEMBLY FOR A REFRIGERATOR FREEZER

BACKGROUND OF THE INVENTION

The present invention relates generally to an automatic ice maker used in the freezer compartment of a refrigerator, and more particularly to a subassembly of such an ice maker which contains the water during formation of the ice cubes and from which the formed ice cubes are later released.

Conventional refrigerator ice makers form ice cubes in the freezer compartment and release the formed ice cubes through a dispenser located in the freezer compartment door. A known refrigerator ice maker fills a metallic (aluminum) ice cube tray with household tap water, allows the water to freeze into crescent-shaped ice cubes, electrically heats a "U"-shaped metallic rod heater located on the bottom of the metallic tray to loosen the individual ice cubes from the tray, uses an electric motor to rotate plastic fingers on a shaft one revolution to sweep the crescent-shaped ice cubes out of the tray into a storage bin, and uses a motor-powered auger in the storage bin to move the ice cubes forward into the dispenser.

Such known refrigerator ice maker has its "U"-shaped metallic rod heater release at least 200 Watts of power during a typical three minute heating cycle, and the refrigerator freezer must use extra energy to remove such heat generated by the rod heater. Since a portion of each ice cube may still be attached to the tray after the three minutes, the electric motor is designed to rotate the plastic fingers with sufficient torque to help dislodge any stuck ice cubes from the tray. What is needed is an ice maker with improved ice cube release.

SUMMARY OF THE INVENTION

It is an object of the invention to provide an ice maker subassembly for a refrigerator ice maker wherein such subassembly allows for improved ice cube release.

The ice maker subassembly of the invention is for a refrigerator freezer and includes a double-sided ice cube tray having a housing, wherein the housing is located within, and attached to, the refrigerator freezer. The housing includes a first side with a number (which must be greater than one) of spaced-apart first ice cube cavities facing generally in a first direction. The housing also includes a second side with a number (which must be greater than one) of spaced-apart second ice cube cavities facing in a second direction generally opposite to the first direction. The ice maker subassembly further includes a mechanism for rotating the housing from a first position wherein the first ice cube cavities face generally upward and the second ice cube cavities face generally downward to a second position wherein the first ice cube cavities face generally downward and said second ice cube cavities face generally upward and for rotating the housing from the second position to the first position.

Preferably, the ice maker subassembly additionally includes apparatus for delivering household water to the ice cube tray, such apparatus including a pivotable water delivery spout having a biased pivotable position and located within the refrigerator freezer such that the water delivery spout is positioned over one of the first and second sides in the biased pivotal position when that one side faces generally upward and such that the water delivery spout is pivoted away from the biased pivotal position by the housing during rotation of the housing by the water delivery apparatus.

In an exemplary embodiment, the refrigerator freezer includes a heater for defrosting the refrigerator freezer and the water delivery apparatus includes a device for heating the household water, wherein such device includes the heater.

Several benefits and advantages are derived from the invention. The double-sided ice cube tray uses the heat from the household water which has just been poured into the ice cube cavities in the upward-facing first side of the tray to detach the frozen ice cubes from the ice cube cavities in the downward-facing second side of the tray, such detached ice cubes thereby being released from the tray by gravity to fall into a conventional storage bin. This eliminates the separate metallic rod heater and the rotating plastic fingers of conventional designs. The household water may receive additional heat from the already existing defroster heater before being delivered to the ice cube tray.

BRIEF DESCRIPTION OF THE DRAWINGS

The accompanying drawings illustrate a preferred embodiment of the present invention wherein.

DETAILED DESCRIPTION OF THE INVENTION

Figure 1:
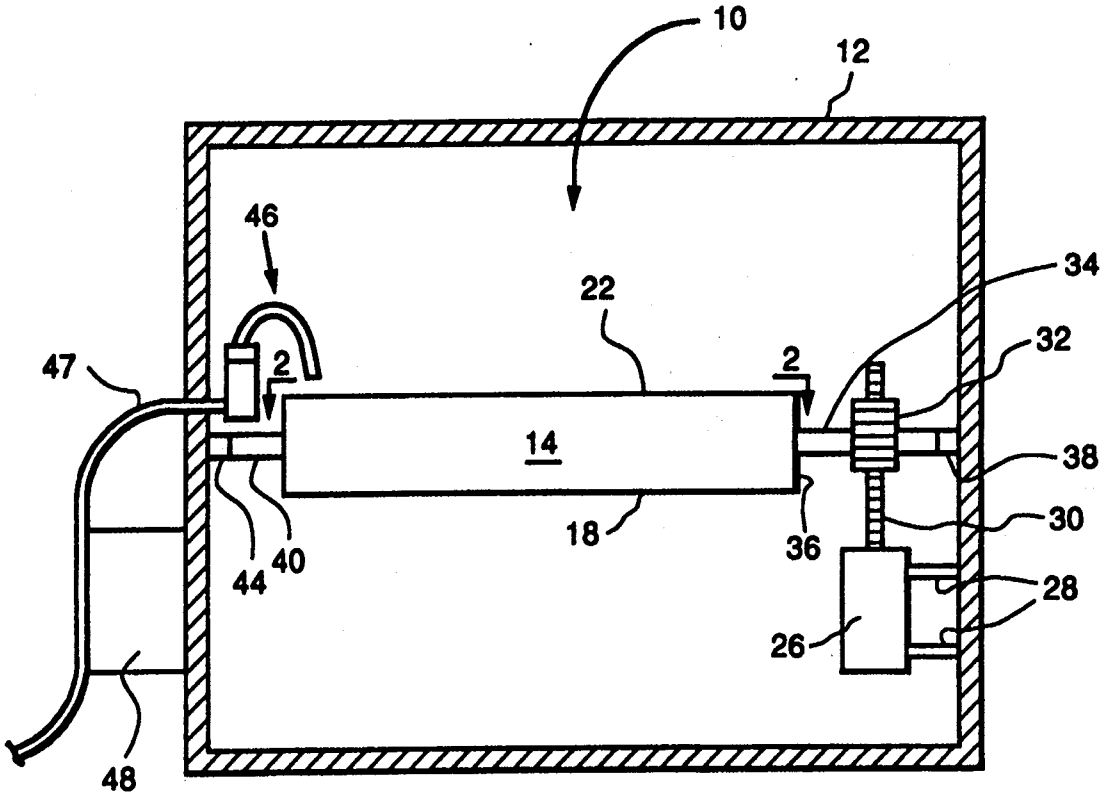
FIG. 1 is a schematic side-elevational view of a preferred embodiment of the ice maker subassembly of the invention installed in a refrigerator freezer shown in section.

Referring now to the drawings, FIGS. 1–4 show a preferred embodiment of the ice maker subassembly 10 of the invention. The ice maker subassembly 10 is for a refrigerator freezer 12 and includes a double-sided ice cube tray 14 having a housing 16, wherein the housing 16 is disposed within and attached (directly or indirectly) to the refrigerator freezer 12. The housing 16 includes a first side 18 with a plurality of spaced-apart first ice cube cavities 20 facing generally in a first direction. The housing 16 further includes a second side 22 with a multiplicity of spaced-apart second ice cube cavities 24 facing in a second direction generally opposite to the first direction.

The ice maker subassembly 10 also includes means for rotating the housing 16 from a first position wherein the first ice cube cavities 20 face generally upward and the second ice cube cavities 24 face generally downward to a second position wherein the first ice cube cavities 20 face generally downward and the second ice cube cavities 24 face generally upward and for rotating the housing 16 from the second position to the first position. Preferably, such means includes a solenoid 26 attached to the refrigerator freezer 12 by brackets 28 and having a plunger 30 serving as a rack which engages a pinion 32 to rotate the pinion 32 generally one-half turn in one direction and then to rotate the pinion 32 generally one-half turn in the opposite direction. The pinion 32 is fixedly attached to a first end shaft 34 which has one end fixedly attached to a first end 36 of the housing 16 and which has the other end rotatably attached to the refrigerator freezer 12 by a first bearing 38. A second end shaft 40 is provided having one end fixedly attached to the second end 42 of the housing 16 and having the other end rotatably attached to the refrigerator freezer 12 by a second bearing 44. It is noted that the housing 16 is rotatably attached to the refrigerator freezer 12 by the rotatable end shares 34 and 40.

Other such means for rotating the housing 16 include the means previously described minus the second end shaft 40 and second bearing 44 and/or the means previously described but having the solenoid 26 replaced by other linear motors, and the like, as can be appreciated by those skilled in the art. Additional such means for rotating the housing 16 include a non-reversible or reversible rotating motor (not shown) which has its drive shaft rotationally attached to (or as one piece with) the first end share 34. It is noted that the housing 16 may be attached to the refrigerator freezer 12 by first having the end shares 34 and 40 (and brackets 28) attached to an ice maker housing (not shown) which is itself attached to the refrigerator freezer 12.

Preferably, the ice maker subassembly 10 additionally includes means for delivering household water to the double-sided ice cube tray 14. The water delivery means includes a pivotable water delivery spout 46 having a biased pivotable position and disposed within the refrigerator freezer 12 such that the water delivery spout 46 is disposed over one of the first and second sides 18 and 22 of the double-sided ice cube tray 14 in the biased pivotal position when the one side faces generally upward and such that the water delivery spout 46 is pivoted away from the biased pivotal position by the housing 16 during rotation of the housing 16 by the housing rotating means. The biasing of the water delivery spout 46 may be accomplished by employing a spring, by using resilient (e.g., rubber or plastic) materials, and the like, as can be appreciated by those skilled in the art. Such water delivery means further includes conventional tubing 47, couplings, valves, controllers, and the like used in conventional refrigerator ice makers to deliver a prescribed quantity of water at appropriate times to the water delivery spout 46, as can be appreciated by the artisan.

In an exemplary embodiment, the housing 16 comprises a metallic housing 16, such as a generally 1.0 to 3.0 (or more) millimeter thick aluminum housing. It is noted that an aluminum housing 16 has a high thermal conductivity (i.e., it is a good thermal conductor) which causes heat to flow more quickly from the water in the water-filled ice cube cavities on one side of the double-sided ice cube tray 14 to the frozen ice cubes in the ice cube cavities on the other side of the double-sided ice cube tray 14.

In operation, at start up, the first and second ice cube cavities 20 and 24 are empty and the housing 16 has been rotated to the first position wherein the first side 18 of the double-sided ice cube tray 14 and its first ice cube cavities 20 face generally upward. The water delivery means delivers household water through the water delivery spout 46 to fill the first ice cube cavities 20. After the water freezes and the ice cubes have been formed, the housing rotating means rotates the housing 16 to the second position wherein the first ice cube cavities 20 containing the attached frozen ice cubes faces downward and the empty second ice cube cavities 24 faces upward. Next, the water delivery means delivers household water through the water delivery spout 46 to fill the second ice cube cavities 24. Such household tap water in the second ice cube cavities 24 has its heat begin to be transferred through the double-sided ice cube tray 14 to the first ice cube cavities 20 containing the attached frozen ice cubes. Such transferred heat melts the ice at the interface of the ice cube and its cavity creating a film of water which serves to detach the ice cube from its cavity and which serves as a lubricant to help in the release of such ice cube, under gravity, from the double-sided ice cube tray 14 into the conventional storage bin below (not shown in the figures). It is noted that the water in the second ice cube cavities 24 will be cooled somewhat by the frozen ice cubes in the first ice cube cavities 20 prior to ice cube release. The double-sided ice cube tray 14 remains in the second position until it has been conventionally determined that the water in the second ice cube cavities 24 has become frozen forming ice cubes. Thereafter, the cycle is repeated until the storage bin becomes filled with ice cubes.

An experiment was performed using a conventional plastic ice cube tray (not shown in the figures) having ice cube cavities only in its top side and which had four plastic plates fitted and sealed to its bottom side to create a bottom reservoir. The conventional tray had its ice cube cavities filled with household water and was placed in a seven-degree Fahrenheit refrigerator freezer. After the water became frozen creating formed ice cubes, the tray was briefly removed from the refrigerator freezer, was turned upside down, had its bottom reservoir filled with seventy-seven-degree Fahrenheit household water covering the back of the bottom and the back of the sides of the ice cube cavities, and was replaced (in the upside-down position) back in the refrigerator freezer. The formed ice cubes would become detached from, and be released from, the ice cube cavities in less than five minutes.

It is noted that a refrigerator freezer having an automatic ice maker (such as refrigerator freezer 12) also has a heater 48 for defrosting the refrigerator freezer. If required, the water delivery means also includes means for heating the household water. Preferably, such water heating means includes the heater 48 with the conventional water delivery tubing 47 being routed in thermal proximity with the heater 48 together with using a conventional controller to activate the heater 48 when water was about to be delivered to the water delivery spout 46 to fill the first or second ice cube cavities 20 or 24. Other such means includes routing the conventional water delivery tubing 47 near the exhaust fan of the refrigerator (not shown in the figures), or employing a small separate water heater, as can be appreciated by those skilled in the art. It is pointed out that, based on the previously-described ice release experiments, it is believed that such heating of the household water to insure ice cube release would not be required.

Figure 2:
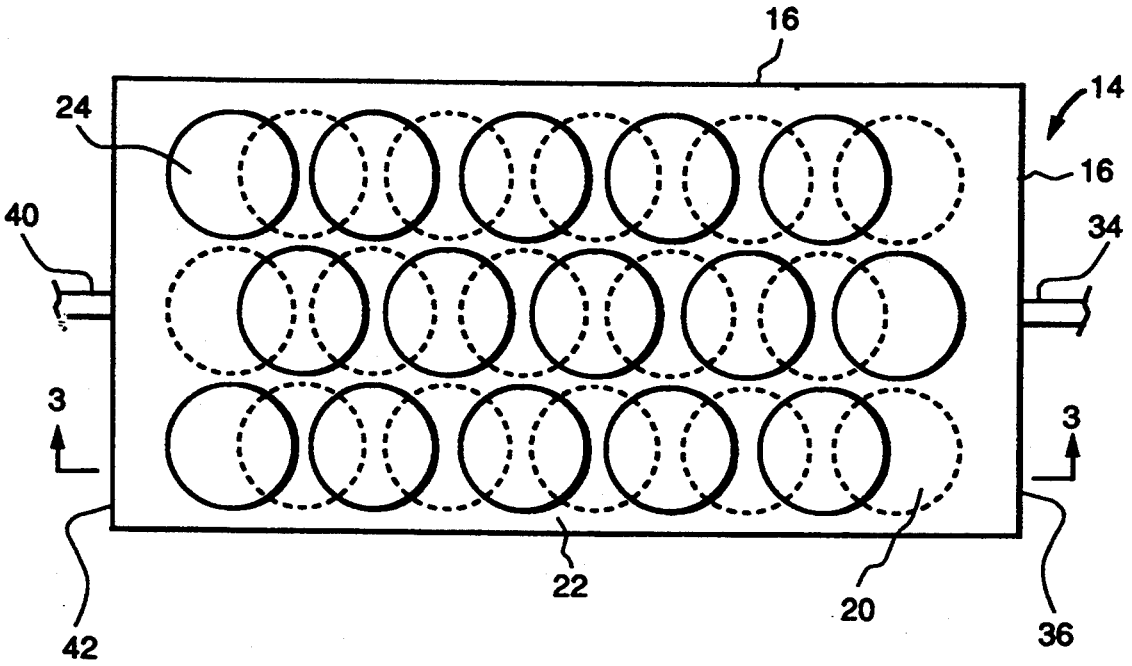
FIG. 2 is a top-planar view of the ice cube tray of the ice maker subassembly taken along lines 2—2 of FIG. 1.
Figure 4:
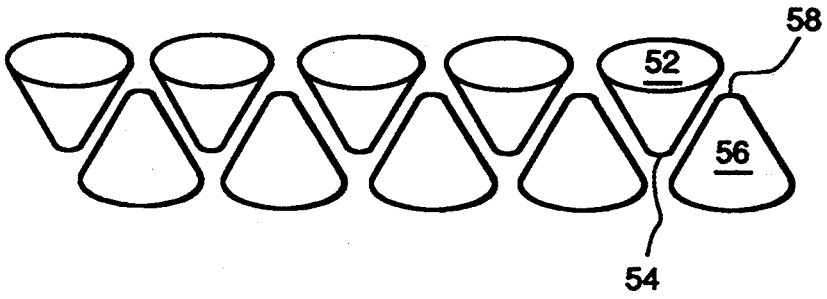
FIG. 4 is a perspective view of FIG. 3, with the contoured wall of the housing of the ice cube tray omitted for clarity, showing the cone-shaped water volumes facing upward and showing the cone-shaped frozen ice cubes, before detachment and release, facing downward.
Figure 3:
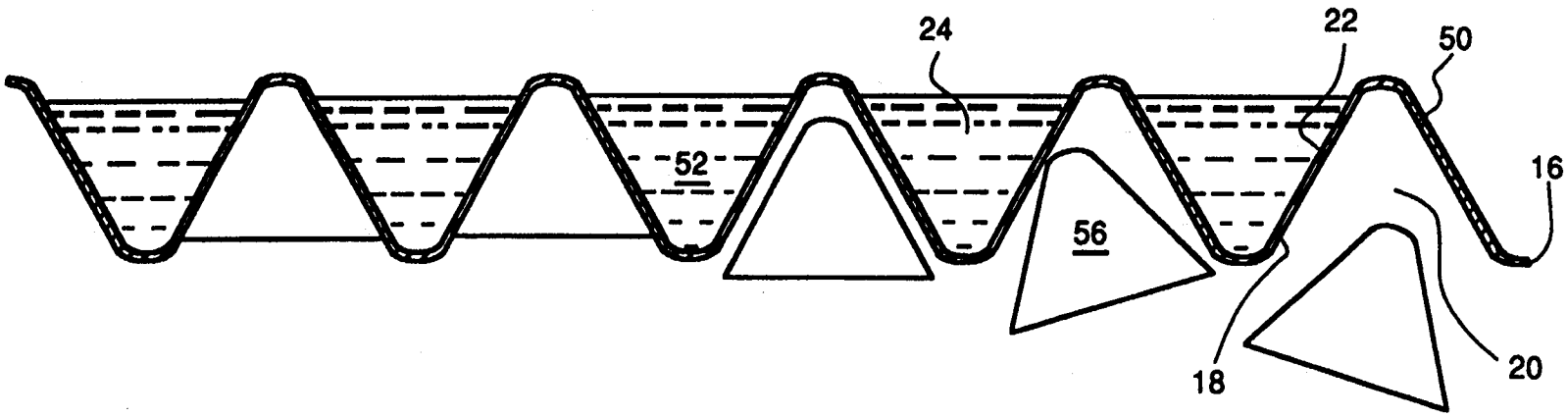
FIG. 3 is a sectional view of the ice cube tray taken along lines 3—3 of FIG. 2 showing those ice cube cavities facing upward which contain the just-delivered household water and showing those ice cube cavities facing downward which contain the frozen ice cubes (with some becoming detached from the tray through the heat of the household water and being released by gravity)

Referring to FIGS. 2 and 3, it is preferred that the housing 16 have a contoured wall 50. The contoured wall 50 includes a first wall surface which is the first side 18 of the double-sided ice cube tray 14 containing the first ice cube cavities 20. The contoured wall 50 also includes a second wall surface which is the second side 22 of the double-sided ice cube tray 14 containing the second ice cube cavities 24. In an exemplary embodiment, the first and second pluralities of ice cube cavities 20 and 24 lie generally in the same plane, and each of the first ice cube cavities 20 abuts at least two of the second ice cube cavities 24. Preferably, each of the first ice cube cavities 20 and each of the second ice cube cavities 24 has the shape of generally a cone, wherein the cone has a rounded apex. The rounded apex aids in ice detachment. To assist in visualizing the invention, FIG. 4 corresponds to one row of the first and second ice cube cavities 20 and 24 wherein the contoured wall 50 of the housing 16 of the double-sided ice cube tray 14 has been omitted for clarity and shows the cone-shaped water volumes 52 (each having a rounded apex 54) facing upward and showing the cone-shaped frozen ice cubes 56 (each having a rounded apex 58), before detachment and release, facing downward.

Other shapes and configurations for the first and second ice cube cavities 20 and 24 are left to the artisan. It is noted that not all ice cube cavities of the first and/or second ice cube cavities 20 and 24 need have the same shape. It is further noted that the contoured wall 50 of the housing 16 need not have a uniform thickness. Preferably, the sides of the ice cube cavities 20 and 24 should be tapered to aid in ice cube release, and the bottom of the ice cube cavities 20 and 24 should be rounded so air gaps will form during ice formation causing the ice cubes to be attached only to the cavity sides (and not to the cavity bottom) to aid in ice cube release, as can be appreciated by those skilled in the art.

A conventional heating cycle time to detach ice cubes from a conventional ice cube tray is three minutes, and the separate conventional "U"-shaped metallic rod heater would release at least 200 Watts of power to detach the ice cubes and require the assistance of the conventional rotating plastic fingers to sweep the conventional crescent-shaped ice cubes from their conventional ice cube tray. In comparison, the ice maker subassembly of the present invention detaches and releases the frozen ice cubes from the ice cube cavities in one side of the tray without a separate heater or rotating plastic fingers, using the heat of the household water (possibly heated further by heat from the defroster heater) which has been delivered to the ice cube cavities in the other side of the tray.

It is noted that for the preferred embodiment of the ice maker subassembly 10 shown in FIGS. 1–4, small notches (not shown in the figures) may be provided in the housing 16 for each ice cube cavity such that water filling one ice cube cavity thereafter will flow more easily to fill all of the other ice cube cavities on that side of the housing 16. It is also noted that two or more ice cubes may remain attached together by a thin bridge of ice when they are released from the double-sided ice cube tray 14, such bridge being later broken when the ice cubes fall into the storage bin or when the auger moves the ice cubes towards the dispenser (such storage bin, auger, and dispenser being conventional and not shown in the figures).

The foregoing description of a preferred embodiment of the invention has been presented for purposes of illustration. It is not intended to be exhaustive or to limit the invention to the precise form disclosed, and obviously many modifications and variations are possible in light of the above teaching. For example, the housing 16 may be a plastic housing. It is intended that the scope of the invention be defined by the claims appended hereto.

I claim:

1. An ice maker subassembly for a refrigerator freezer, said ice maker subassembly comprising:

a) a double-sided ice cube tray having a housing, said housing disposed within and attached to said refrigerator freezer, said housing including a first side with a plurality of spaced-apart first ice cube cavities facing generally in a first direction, and said housing including a second side with a multiplicity of spaced-apart second ice cube cavities facing in a second direction generally opposite to said first direction;

b ) means for rotating said housing from a first position wherein said first ice cube cavities face generally upward and said second ice cube cavities face generally downward to a second position wherein said first ice cavities face generally downward and said second ice cube cavities face generally upward and for rotating said housing from said second position to said first position; and c) means for delivering household water to said ice cube tray, said water delivery means including a pivotable water delivery spout having a biased pivotable position and disposed within said refrigerator freezer such that said water delivery spout is disposed over one of said first and second sides in said biased pivotal position when said one side faces generally upward and such that said water delivery spout is pivoted away from said biased pivotal position by said housing during rotation of said housing by said housing rotating means.

2. An ice maker subassembly for a refrigerator freezer having a heater for defrosting said refrigerator freezer, said ice maker subassembly comprising:

a) a double:sided ice cube tray having a housing, said housing disposed within and attached to said refrigerator freezer, said housing including a first side with a plurality of spaced-apart ice cube cavities facing generally, in a first direction, and said housing including a second side with a multiplicity of spaced-apart second ice cube cavities facing in a second direction generally opposite to said first direction;

b) means for rotating said housing from a first position wherein said first ice cube cavities face generally upward and said second ice cube cavities face generally downward to a second position wherein said first ice cube cavities face generally downward and said second ice cube cavities face generally upward and for rotating said housing from said second position to said first position; and c) means for delivering household water to said ice cube tray, said water delivery means including means for heating said household water and said water heating means including said heater.

* * * * *